US009685751B2

(12) United States Patent
Yu et al.

(10) Patent No.: US 9,685,751 B2
(45) Date of Patent: Jun. 20, 2017

(54) ELECTRICAL CONNECTOR

(71) Applicant: FOXCONN INTERCONNECT TECHNOLOGY LIMITED, Grand Cayman (KY)

(72) Inventors: Chun-Ming Yu, Kunshan (CN); Juan Du, Kunshan (CN); Bin Guo, Kunshan (CN); Guo-Hua Zhang, Kunshan (CN); Liang Gong, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/231,291

(22) Filed: Aug. 8, 2016

(65) Prior Publication Data

US 2017/0040730 A1 Feb. 9, 2017

(30) Foreign Application Priority Data

Aug. 6, 2015 (CN) ..... 2015 2 0585497 U

(51) Int. Cl.

| | |
|---|---|
| ***H01R 43/24*** | (2006.01) |
| ***H01R 13/405*** | (2006.01) |
| ***H01R 12/71*** | (2011.01) |
| ***H01R 24/62*** | (2011.01) |
| ***H01R 43/16*** | (2006.01) |
| ***H01R 13/6585*** | (2011.01) |
| *H01R 107/00* | (2006.01) |

(52) U.S. Cl.

CPC ..... *H01R 43/24* (2013.01); *H01R 12/716* (2013.01); *H01R 13/405* (2013.01); *H01R 13/6585* (2013.01); *H01R 24/62* (2013.01); *H01R 43/16* (2013.01); *H01R 2107/00* (2013.01)

(58) Field of Classification Search

CPC ..... H01R 43/24

See application file for complete search history.

(56) References Cited

U.S. PATENT DOCUMENTS

2013/0227839 A1* 9/2013 Lee ..... H01R 43/24 29/858
2015/0357771 A1* 12/2015 Chen ..... H01R 24/70 439/607.01
2015/0364888 A1* 12/2015 Yu ..... H01R 13/6585 264/250

FOREIGN PATENT DOCUMENTS

CN 204361412 U 5/2015
TW M490141 U 11/2014

* cited by examiner

*Primary Examiner* — James Harvey
(74) *Attorney, Agent, or Firm* — Wei Te Chung; Ming Chieh Chang

(57) ABSTRACT

An electrical connector comprises a first terminal module, a second module and a shell. The first terminal module has a first insulator and a plurality of first terminals embedded in the first insulator. The first insulator has a first vertical portion, a first horizontal portion and a first tongue plate. The second terminal module has a second insulator and a plurality of second terminals embedded in the second insulator. The second insulator has a second vertical portion, a second horizontal portion and a second tongue plate. The second vertical portion and the second horizontal portion are separated from each other, and the second terminal connects the second vertical portion with the second horizontal portion.

15 Claims, 5 Drawing Sheets

ELECTRICAL CONNECTOR

FIELD OF THE INVENTION

The present invention relates to an electrical connector.

DESCRIPTION OF THE PRIOR ART

Chinese Patent Issued No. 204361412U discloses an electrical connector including an upper terminal module, a lower terminal module and a shielding plate disposed between the upper terminal module and the lower terminal module. The top terminal module includes a top insulator and a plurality of top terminals embedded in the top insulator via a first insert molding process. The lower terminal module includes a lower insulator and a plurality of lower terminals embedded in the lower insulator via a second insert molding process. Each of the terminals includes a contacting portion exposed on a horizontal portion of corresponding insulators and a mounting portion extending backwardly beyond the insulators. The mounting portions are surface mounted to an exterior board. The mounting portions are disposed parallel to the contacting portions, therefore the mounting portions and contacting portions could be easily retained to an insert molding machine only in one direction to injection plastic material to form the insulator. At some applications, the mounting portions are disposed vertically to mount to an exterior board through a through-hole manner. However, if the mounting portions are disposed vertical to the contacting portions, it is difficult to retain the terminals to the insert molding machine along two vertical directions.

SUMMARY OF THE INVENTION

Accordingly, an object of the present invention is to provide an electrical connector including a first terminal module and a second terminal module assembled to the first terminal module along a vertical direction. The first terminal module has a first insulator and a plurality of first terminals embedded in the first insulator via a first insert molding process. The second terminal module has a second insulator and a plurality of second terminals embedded in the second insulator via a second insert molding process. The second insulator has a second vertical portion extending along the vertical direction and a second horizontal portion extending along a front-to-back direction perpendicular to the vertical direction. Each of the second terminals includes a second contacting portion exposed on the horizontal portion and a mounting portion extending vertically beyond the vertical direction. The second vertical portion and the second horizontal portion are separated from each other. The second terminals have bending portions disposed between the second vertical portion and the second horizontal portion. Notably, the bending portions are formed by a pressing process after the second insert molding process. The second vertical portions could be disposed parallel to the second mating portions before the second insert molding process to easily retain the second terminals to an insert molding machine only in one same horizontal direction.

DESCRIPTION OF PREFERRED EMBODIMENT

Reference will now be made to the drawings to describe the present invention in detail.

Figure 1:
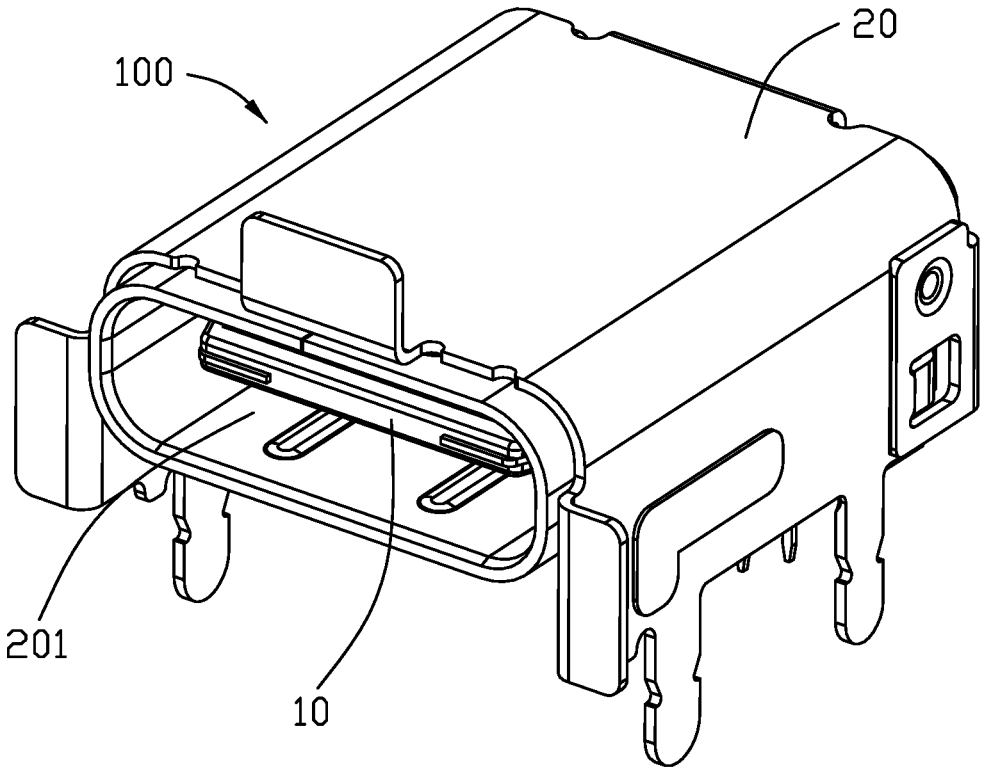
FIG. 1 is a perspective view of an electrical connector in accordance with the present invention.
Figure 2:
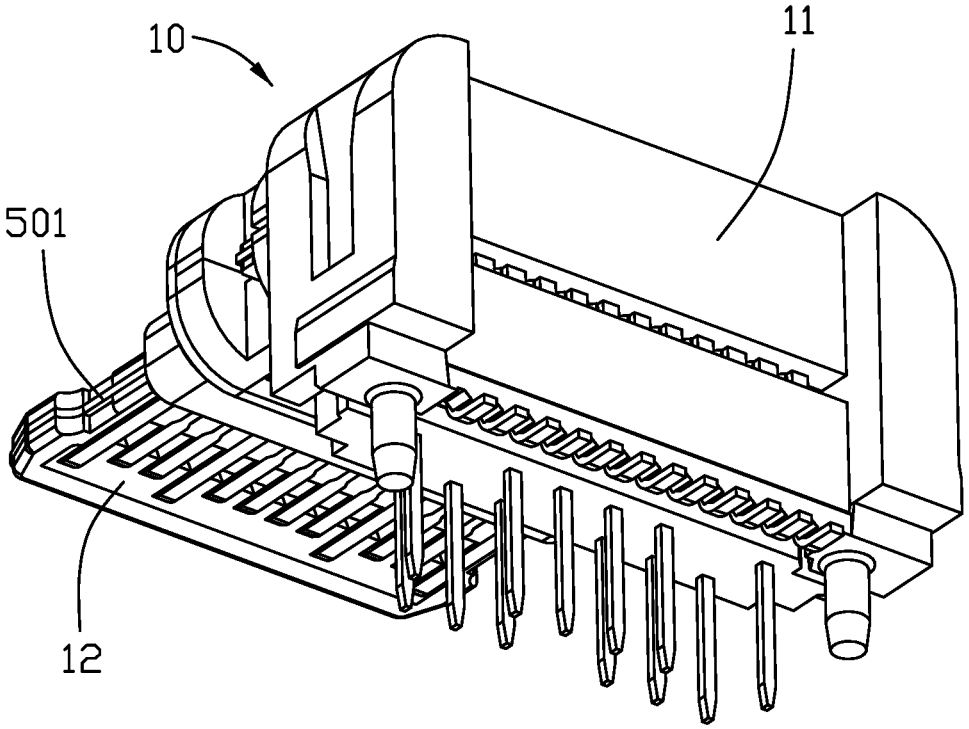
FIG. 2 is a perspective view of the terminal block shown in FIG. 1.
Figure 3:
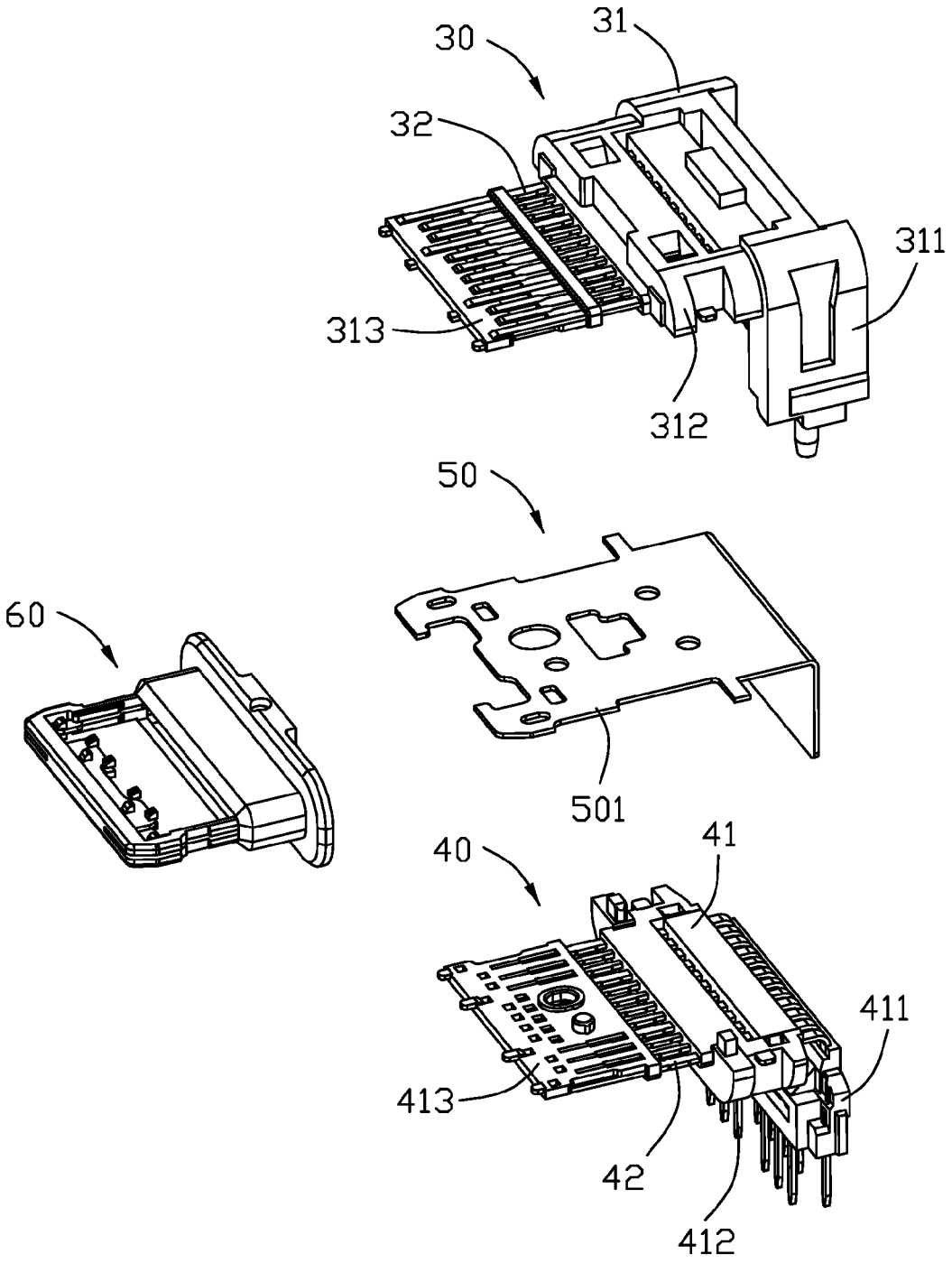
FIG. 3 is an exploded perspective view of the terminal block shown in FIG. 2.
Figure 4:
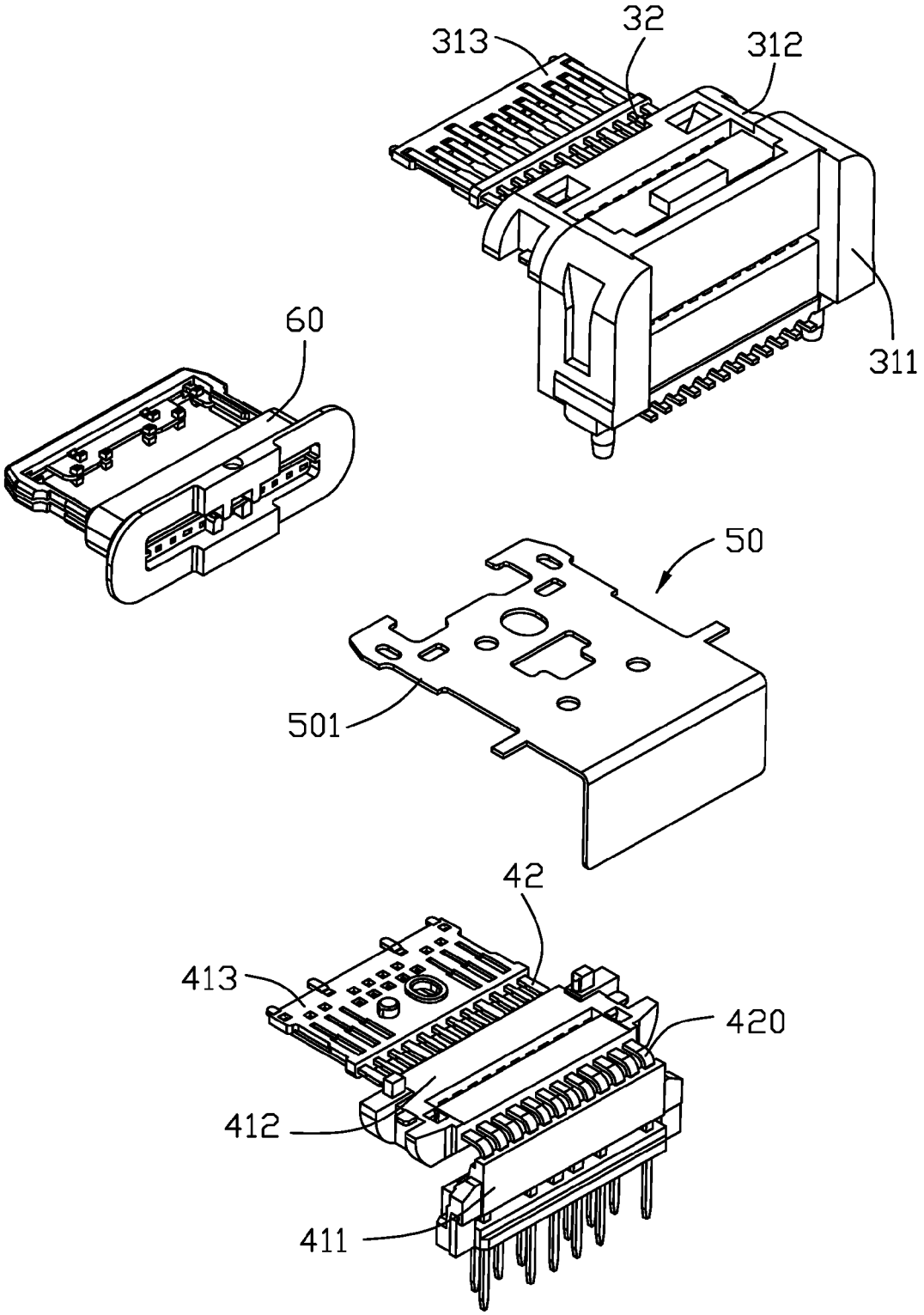
FIG. 4 is another exploded perspective view of the terminal block shown in FIG. 3.
Figure 5:
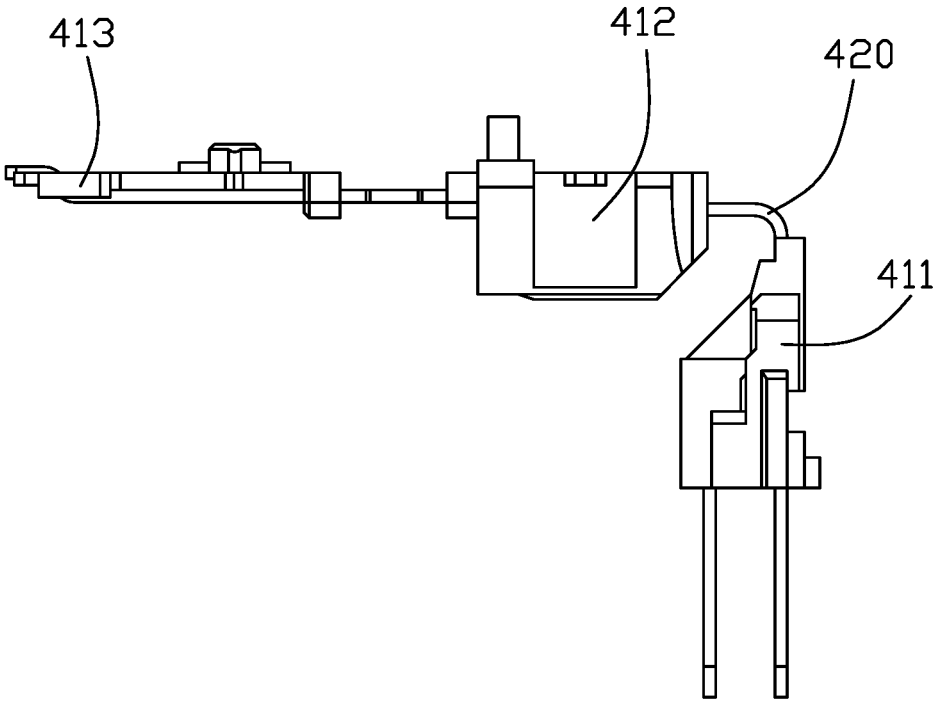
FIG. 5 is a side view of the second terminal module shown in FIG. 4.

Referring to FIGS. 1-5, an electrical connector 100 is a USB Type C receptacle connector. The electrical connector 100 is used for receiving a plug connector by two opposite directions. The electrical connector 100 includes a terminal block 10 and a shell 20. The terminal block 10 includes a rear base 11 and a tongue plate 12 extending forwardly from the rear base 11. The shell 20 surrounds around the tongue plate 12. The shell 20 forms a mating cavity 201 extending along a front-to-back direction to communicate to exterior.

The terminal block 10 includes a first terminal module 30 and a second terminal module 40 located below the first terminal module 30. The first terminal module 30 includes a first insulator 31 and a plurality of first terminals 32 embedded in the first insulator 31 via a first insert molding process. The first insulator 31 includes a first vertical portion 311, a first horizontal portion 312 and a first tongue plate 313. Each of the first terminals 32 includes a first contacting portion and a first mounting portion. The first contacting portion is exposed on the first horizontal portion 312. The first mounting portion extends from the first vertical portion 311 and is parallel to the first contacting portion. Each of the first terminals 32 has a first bending portion connected between the first contacting portion and the first mounting portion, and the first bending portions are embedded in the first insulator 31 and formed by a pressing process before the first inserting molding process. The second terminal module 40 is assembled to the first terminal module 30 along a vertical direction. The second terminal module 40 includes a second insulator 41 and a plurality of second terminals 42 embedded in the second insulator 41 via a second insert molding process. The second insulator 41 includes a second vertical portion 411 extending along the vertical direction and a second horizontal portion extending along a front-to-back direction perpendicular to the vertical direction. The second horizontal portion includes two parts (412,413) spaced from each other along the front-to-back direction. The second vertical portion 411 and the second horizontal portion (412, 413) are separated from each other, and the second terminal 42 connects the second vertical portion 411 with the second horizontal portion 412. Each of the second terminals 42 includes a second contacting portion exposed on the second horizontal portion 413 and a second mounting portion extending vertically beyond the second vertical portion 411. The second mounting portions are disposed at two different rows along the front-to-back direction. The second terminal 42 includes a bending portion 420 disposed between the second horizontal portion 412 and the second vertical portion 411. The bending portions 420 are formed by a pressing process after the second insert molding process. That is, the bending portion 420 is formed by pressing the second vertical portion 411 from a horizontal state to a vertical state. The second mounting portions extend vertical to the first mounting portions. The terminal block 10 comprises a covering portion 60 over-molded upon the first horizontal portion 312 and the second horizontal portion 412, the first and second contacting portions exposed upon the opposite surfaces of the cover portion 60. The electrical connector 100 includes a receiving space under the first horizontal portion 312 and the first vertical portion 311 to receive the second horizontal portion 412 and the second vertical portion 411, respectively. The electrical connector 100 also includes a shielding plate 50 disposed between the first terminal module 30 and the second terminal module 40. The shielding plate 50 includes a locking portion 501 to lock with a mating connector.

A method of making the electrical connector 100, comprising steps of:

Providing a first terminal module 30 with a plurality of first terminals 32 embedded with a first insulator 31 via a first insert-molding process. The first terminals 32 are formed as Z-shaped before the first insert-molding process. Providing a second terminal module 40 with a plurality of second terminals 42 embedded with a second insulator 41 via a second insert-molding process. The second insulator 41 including a first part and a second part spaced therefrom along a front-to-back direction and parallel with each other, the second terminals 42 including contacting portions exposed on the first part and mounting portions extending backwardly beyond the second part. Pressing the second part to vertical to the first part to form a second vertical portion 411 and a second horizontal portion 412, the second terminals 42 formed bending portions 420 between the second vertical portion 411 and the second horizontal portion 412 after the pressing process, the second mounting portions being vertical to the second contacting portions after the pressing process.

Secondly, providing a shielding plate 50 sandwiched between the first terminal module 30 and the second terminal module 40.

Thirdly, applying a covering portion 60 upon the first terminal module 30 and the second terminal module 40 via an over-molding process.

Lastly, providing a shell 20 to surround around outsides of the first horizontal portion 312, the second horizontal portion 412, the first vertical portion 311 and the second vertical portion 411.

The second terminals 42 are embedded in the second horizontal portion 412 and the second vertical portion 411 when they are in a horizontal state. The second terminal 42 includes a bending portion 420 exposed between the second horizontal portion 412 and the second vertical portion 411. The bending portion 420 is formed by pressing the second vertical portion 411 from a horizontal state to a vertical state. It is convenient to assemble the electrical connector 100 and have a mass production.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector comprising:

a first terminal module having a first insulator and a plurality of first terminals embedded in the first insulator via a first insert molding process; and a second terminal module assembled to the first terminal module along a vertical direction, the second terminal module having a second insulator and a plurality of second terminals embedded in the second insulator via a second insert molding process, the second insulator having a second vertical portion extending along the vertical direction and a second horizontal portion extending along a front-to-back direction perpendicular to the vertical direction, each of the second terminals including a second contacting portion exposed on the horizontal portion and a mounting portion extending vertically beyond the vertical direction; wherein the second vertical portion and the second horizontal portion are separated from each other, the second terminal have bending portions disposed between the second vertical portion and the second horizontal portion, and the bending portions are formed by a pressing process after the second insert molding process; the second insulator includes a second horizontal portion including two parts spaced from each other along the front-to-back direction.

2. The electrical connector as claimed in claim 1, wherein the mounting portions are disposed at two different rows along the front-to-back direction.

3. The electrical connector as claimed in claim 1, further comprising a shielding plate disposed between the first terminal module and the second terminal module, wherein the shielding plate has a locking portion to lock with a mating connector.

4. The electrical connector as claimed in claim 1, wherein the first insulator includes a first horizontal portion and a first vertical portion, and each of the first terminals includes a first contacting portion exposed on the first horizontal portion, a first mounting portion extending from the first vertical portion and parallel to the first contacting portion.

5. The electrical connector as claimed in claim 4, wherein each of the first terminals has a first bending portion connected between the first contacting portion and the first mounting portion, and the first bending portions are embedded in the first insulator and formed by a pressing process before the first inserting molding process.

6. The electrical connector as claimed in claim 4, further comprising a covering portion over-molded upon the first horizontal portion and the second horizontal portion, the first and second contacting portions exposed upon the opposite surfaces of the cover portion.

7. The electrical connector as claimed in claim 4, wherein the second mounting portions extend vertical to the first mounting portions.

8. An electrical connector comprising:

a terminal module including a plurality of terminals integrally formed with an insulator set and side by side arranged with one another along a transverse direction, each of said terminals including a horizontal section extending along a front-to-back direction perpendicular to said transverse direction, and a vertical section perpendicular to both said transverse direction and said front-to-back direction;

said insulator set including a front horizontal portion grasping front portions of the horizontal sections of said terminals, a rear horizontal portion spaced from said front horizontal portion in said front-to-back direction and grasping rear portions of the horizontal sections of said terminals, and a vertical portion grasping said vertical sections of said terminals; wherein upper portions of the vertical sections of all said terminals are aligned with one another in said transverse direction while lower portions of the vertical sections of some of said terminals are offset from those of remainders in said front-to-back direction, and said vertical portion encloses both said upper portions and said lower portions of the vertical sections of said terminals.

9. A method of making an electrical connector assembly, comprising steps of:

providing a first terminal module with a plurality of first terminals embedded with a first insulator via a first insert-molding process;

providing a second terminal module with a plurality of second terminals embedded with a second insulator via a second insert-molding process, the second insulator including a first part and a second part spaced therefrom along a front-to-back direction and parallel with each other, the second terminals including second contacting portions exposed on the first part and second mounting portions extending backwardly beyond the second part;

pressing the second part to vertical to the first part to form a second vertical portion and a second horizontal portion, the second terminals formed a plurality of bending portions between the second vertical portion and the second horizontal portion after the pressing process, the second mounting portions being vertical to the second contacting portions after the pressing process;

providing a shielding plate sandwiched between the first terminal module and the second terminal module;

applying a covering portion upon the first terminal module and the second terminal module via an over-molding process.

10. The method as claimed in claim 9, wherein the first terminals are formed as Z-shaped before the first insert molding process.

11. The method as claimed in claim 10, wherein the first insulator includes a first horizontal portion and a first vertical portion connected thereto, each of the first terminals includes a first contacting portion exposed upon the first horizontal portion, a first mounting portion extending parallel to the first contacting portions, and a bending portion embedded in the first insulator.

12. The method as claimed in claim 9, wherein the second mounting portions are arranged as two different rows before the second insert molding process.

13. The electrical connector as claimed in claim 8, further including another terminal module to be assembled with said terminals module in said vertical direction to sandwich a metallic shielding plate therebewteen in the vertical direction.

14. The electrical connector as claimed in claim 13, wherein joint portions between said horizontal sections and said vertical sections are exposed to an exterior for bending consideration.

15. The electrical connector as claimed in claim 14, wherein the insulator set is integrally formed with the terminals via an insert-molding process while a space between the front horizontal portion and the rear horizontal portion is filled with insulative material via another insert-molding process after the both said two terminal modules are assembled together in said vertical direction.

* * * * *